United States Patent [19]

Green

[11] Patent Number: 4,720,940

[45] Date of Patent: Jan. 26, 1988

[54] ROTARY DRUM SANDER

[76] Inventor: Gary L. Green, 17065 Judicial Rd., Lakeville, Minn. 55044

[21] Appl. No.: 934,007

[22] Filed: Nov. 24, 1986

Related U.S. Application Data

[63] Continuation-in-part of Ser. No. 778,712, Sep. 23, 1985, abandoned.

[51] Int. Cl.[4] ..... B24B 41/00

[52] U.S. Cl. ..... 51/166 R; 51/364; 408/20; 408/27; 29/460; 29/30; 144/1 R

[58] Field of Search ..... 51/166 R, 166 TS, 166 MH, 51/206 R, 72 R, 102, 364, 367, 369; 144/1 R, 35 A; 408/20, 24, 27; 409/228, 236; 29/460, 28, 30

[56] References Cited

U.S. PATENT DOCUMENTS

| | | | |
|---|---|---|---|
| 414,115 | 10/1889 | Kenyon | 51/369 |
| 1,469,307 | 10/1923 | Keltie | 51/367 |
| 3,404,714 | 10/1968 | Runkle et al. | 144/1 R |
| 3,611,643 | 10/1971 | Crane et al. | 51/206 R |

*Primary Examiner*—Roscoe V. Parker

*Attorney, Agent, or Firm*—Merchant, Gould, Smith, Edell, Welter & Schmidt

[57] ABSTRACT

A drum sander (10) for woodworking which may be used in combination with a radial arm saw (25). The drum sander (10) includes a horizontal, rotatable sanding cylinder (31) which is supported above a work table (20). The wood (not shown) to be sanded is inserted beneath the sanding cylinder (31) on top of the work table (22). The sanding cylinder is supported, in two different embodiments, by either one (17) or two (17 and 55) vertical supports. The sanding cylinder (31) is also supported, in two different embodiments, by either a horizontal carriage arm (11) or a carrier bracket (52). The drum sander (10) also includes a slide fastener (34) which attaches the sandpaper strips (60) onto the sanding cylinder (31). Also disclosed is a removable dust collector (16) which covers the upper portion of the sanding cylinder (31) and is connected to the hose (49) of a vacuum.

16 Claims, 10 Drawing Figures

FIG. 6
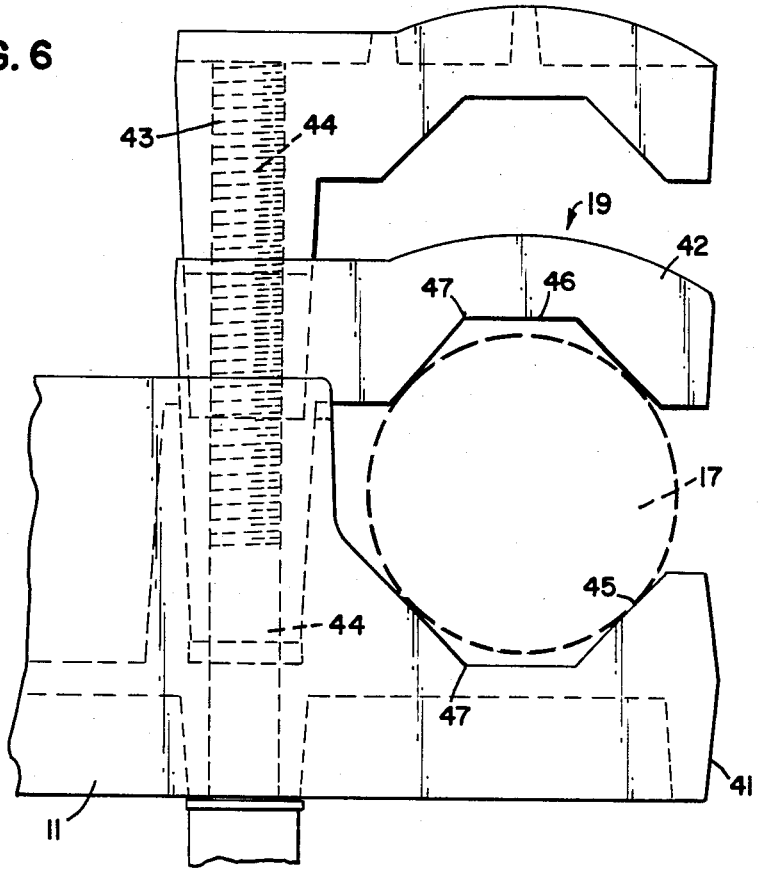
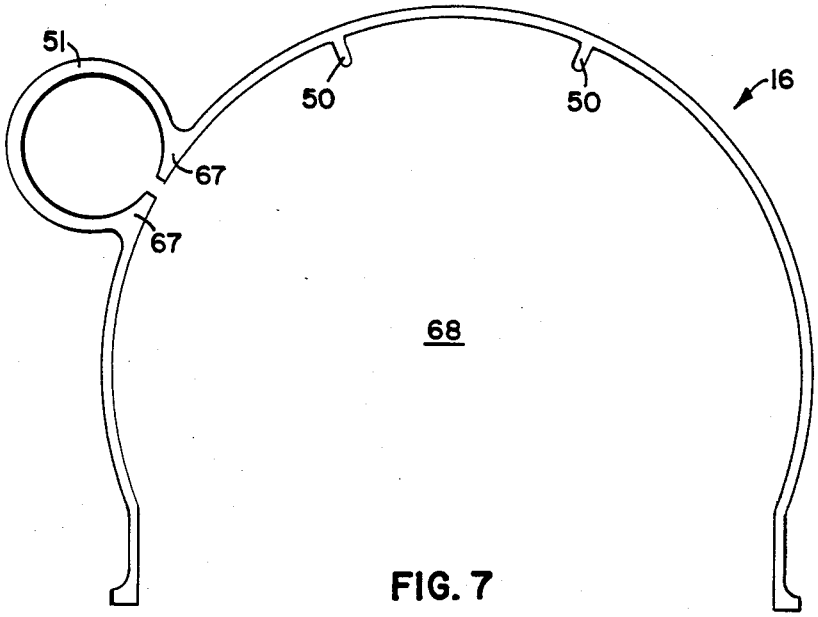
FIG. 7

ROTARY DRUM SANDER

BACKGROUND OF THE INVENTION

This is a continuation-in-part application of U.S. patent application Ser. No. 778,712, filed Sept. 23, 1985 and now abandoned.

This invention pertains to a drum sander accessory for woodworking and more particularly to such a device which can be adapted for use with radial arm type saws.

Sanding machines are currently available, but they are expensive and require significant space. Also, the attachment of the sandpaper to a conventional sanding machine is difficult and time-consuming, because either adhesive or tape must be used. This is particularly important when the operator must change the sandpaper several times during a single woodworking project to produce various degrees of abrasion or coarseness.

Further, the adjustment of the sanding cylinder relative to the work table is often complex when the table, rather than the sanding cylinder, must be adjusted vertically an even, uniform distance. The table adjustment is typically accomplished by means of a screw and sprocket at each corner of the table, with the screws being interconnected with a chain. This assembly tends to be relatively expensive and complicated. In addition, conventional drum sanders usually contain a hollow, metal shaft in the center with closed metal ends. The varying degree of metal along the length of the sanding cylinder, and the high heats under which the sander is operated, cause the cylinder to warp after extended use, instead of maintaining a straight horizontal configuration. Finally, a conventional sanding machine is able to sand only a relatively narrow piece of wood, because of obstructions or supports on each end of the sanding cylinder.

Radial arm saws have become commonplace in both commercial and home woodworking workshops. It is therefore, desirable to provide a drum sander which is convenient to operate, able to sand wide pieces of wood, and able to be attached to radial arm saws.

SUMMARY OF THE INVENTION

One object of the invention is to provide a sanding attachment that is simple, durable, and economical.

Another object of the invention is to provide a quick, convenient and secure attachment of the sandpaper to the sanding cylinder. A slide fastener is provided for each end of the sanding cylinder to carry out this objective.

Another object of the invention is to provide a sanding cylinder with a constant rate of thermal expansion throughout its length, so that the sanding drum maintains a straight horizontal configuration and does not warp or sag in the central portion after extended use. This objective is accomplished by forming the sanding cylinder from extrusion processes so that there is a constant amount of metal throughout the length of the sanding cylinder.

A further object of the invention is to provide a sanding cylinder which is supported on only one of its ends above the work table. This design feature enables the wood to be inserted without being hindered by a support at both ends, and thereby enables a much wider piece of wood to be sanded.

Another object of the invention is to provide a sanding device that can attach to an ordinary radial arm saw.

Consequently, the invention utilizes the features of a radial arm saw in order to provide the sanding device of the present invention with a power source, a work table, and an adjustable vertical column.

A further object of the invention is to provide a device that is readily adjustable to provide parallel alignment of the sanding cylinder relative to the work table. The device is lightweight and is provided with a convenient clamp attachment for adjustment and removal purposes.

These and other objects of the invention will become apparent from a consideration of the following specification and accompanying drawings which form a part of this application.

In carrying out the objects of the invention, it is to be understood that its essential features are susceptible of change in design and structural arrangement, with only one preferred and practical embodiment being illustrated in the accompanying drawings, as required.

BRIEF DESCRIPTION OF THE DRAWINGS

FIG. 6 is a plan view of the clamp of the preferred embodiment of the clamp of the present invention.

FIG. 7 is a side elevational view of the preferred embodiment of the dust collector of the present invention.

DESCRIPTION OF THE PREFERRED EMBODIMENTS

Figure 1:
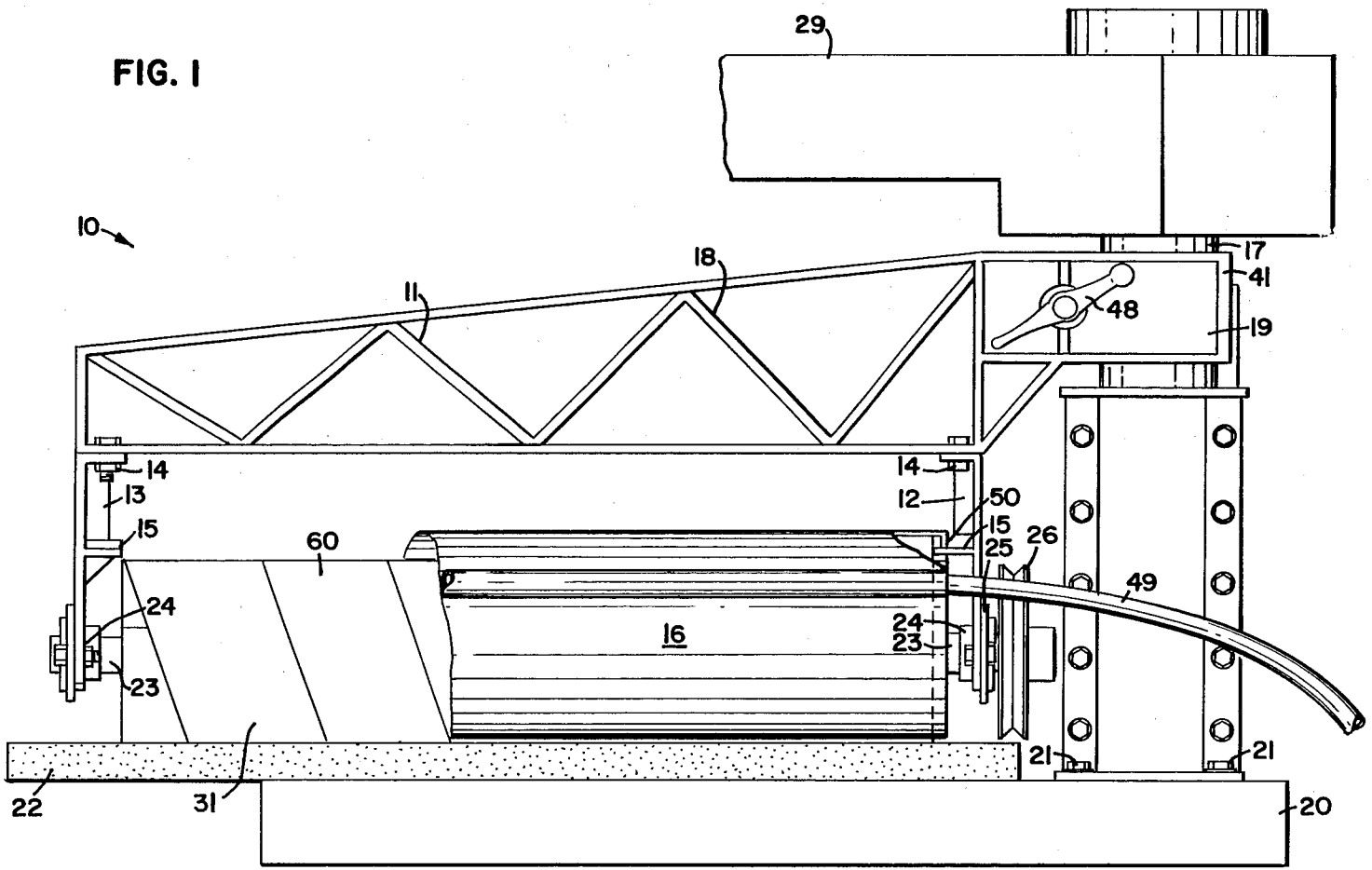
FIG. 1 is a side elevational view of the preferred embodiment of the drum sander of the present invention.
Figure 2:
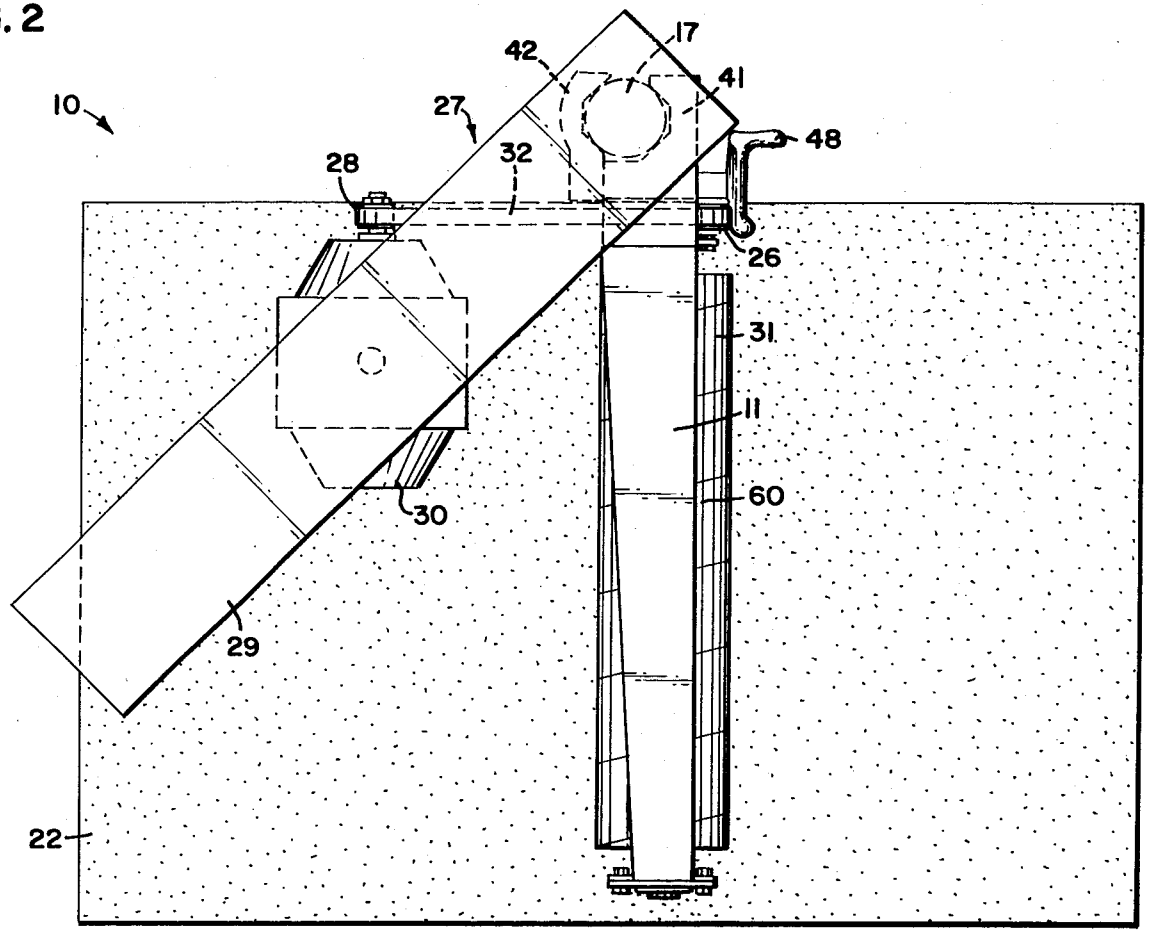
FIG. 2 is a plan view of the drum sander shown in FIG. 1 and the horizontal arm of the radial arm saw.
Figure 3:
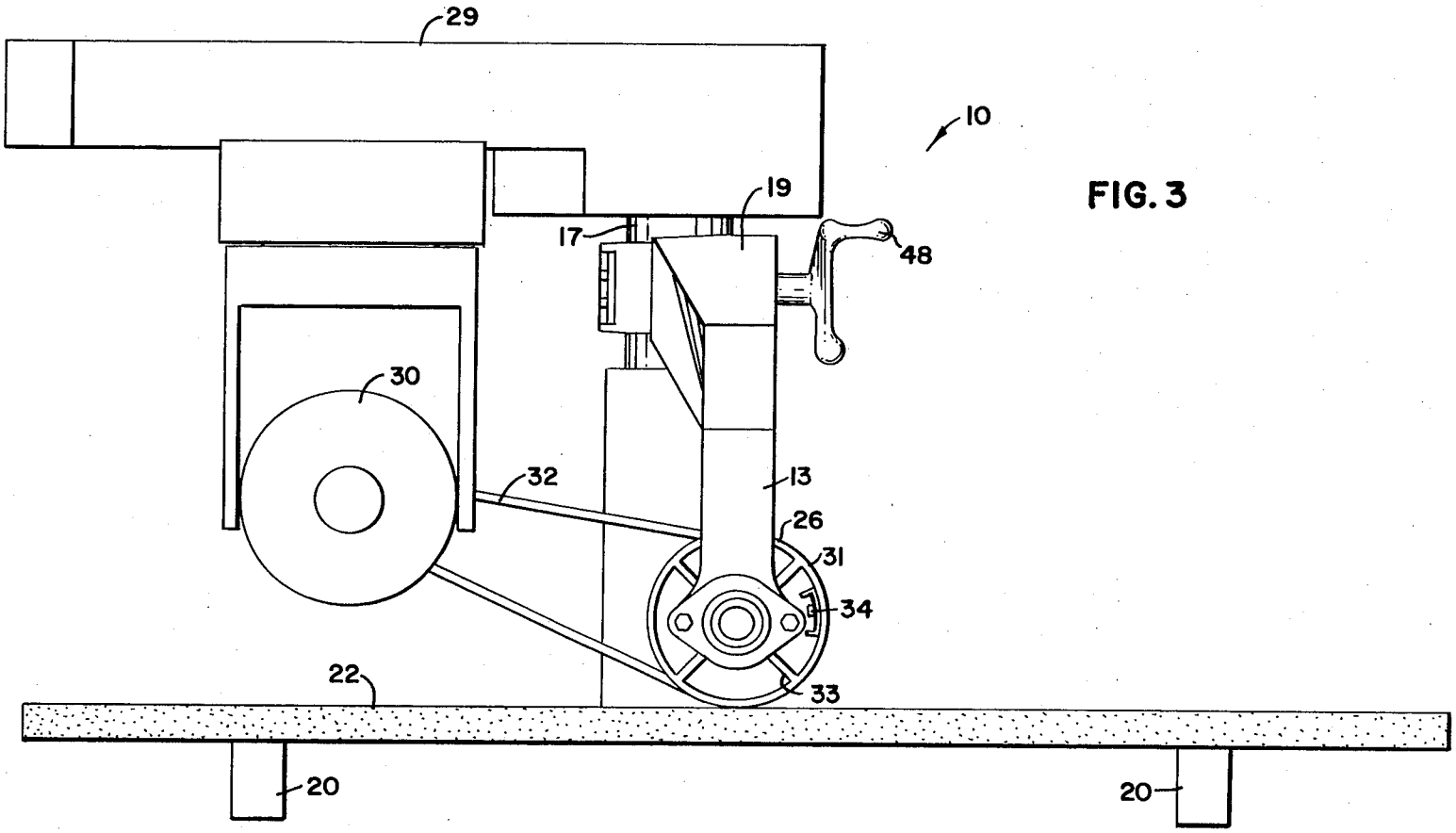
FIG. 3 is a side elevational view of the drum sander and attachment shown in FIG. 2.

The preferred embodiment of the drum sander 10 of the present invention is shown in FIGS. 1–3. The drum sander 10 has a sanding cylinder 31 which rotates when the drum sander is in use to sand a wooden board (not shown). The sanding cylinder 31 is adjusted by the user to be parallel to the work table 22 and the work table support 20. The sanding cylinder 31 is supported by a substantially horizontal frame carriage arm 11 which is connected to a pair of vertical carriage legs 12 and 13 by suitable fasteners 14, such as bolts. The carriage arm 11 is framed rather than solid to provide a sufficient amount of strength with a minimum amount of weight. The frame members 18 of the carriage arm 11 provide the necessary strength to support the sanding cylinder 31 above the work table 20, with there being a support 17 at only one end of the sanding cylinder 31, rather than at both ends. The carriage arm 11 and carriage legs 12 and 13 are made of a lightweight metal such as aluminum. The inside of each vertical carriage leg 13 has a transverse integral seat 15 positioned above the top of the sanding cylinder 31 upon which a dust collector 16 attaches.

The drum sander 10 is attached at one end to a vertical support 17. The vertical support 17 may or may not be the vertical adjustable column of a radial arm saw. If the drum sander 10 is used as an attachment to a radial arm saw 27, various features of the radial arm saw 27 are employed: the motor 30 of the radial arm saw 27 is used to rotate the sanding cylinder 31; the adjustable vertical column 17 of the radial arm saw 27 is used to vertically adjust the position of the sanding cylinder 31; and the work table 22 of the radial arm saw 27 is used to support the piece of wood being sanded. Figures 1–3 and 8 illustrate the drum sander 10 being used in conjunction with a radial arm saw 27. However, the drum sander 10 could also be used without a radial arm saw 27 by attaching it to a conventional motor. Either a separate adjustable vertical support or an adjustable work table connected to a nonadjustable support would serve the same functions as the adjustable vertical column 17 of a radial arm saw 27.

The drum sander 10 is attached to the vertical support 17 by means of a clamp 19. The clamp 19 can be loosened and adjusted vertically by turning a clamp handle 48. The vertical support 17 is rigidly attached to the work table 20 with suitable fasteners 21. The piece of wood to be sanded (not shown) is inserted manually beneath the bottom of the sanding cylinder 31 and on top of the work table 22. The sanding cylinder 31 contains within it a relatively small central cylindrical hollow shaft 23. The shaft 23 is inserted through apertures 24 in the vertical carriage legs 13. The rotation of the sanding cylinder 31 is facilitated by ball bearings 25 connected to the vertical carriage legs 13. The ball bearings are fastened to slots in the carriage legs 13 which allow for parallel alignment of the drum 31 to the work table 22. On the end of the sanding cylinder 31 proximate the vertical support 17, there is a driven pulley 26. The driven pulley 26 is affixed to the center shaft 23.

When the drum sander 10 is used in combination with a radial arm saw 27, the radial arm saw blade is replaced with an arbor drive pulley 28, as shown in FIGS. 2 and 3. The radial arm 29 of the saw is positioned as desired, and the motor carriage 30 is positioned properly along the radial arm 29 of the saw. The drum sander 10 is then attached to the vertical adjustable support column 17 of the radial arm saw 27 by means of the clamp 19. The motor carriage 30 is swiveled to allow placement of a belt 32 around both the arbor drive pulley 28 and the driven pulley 26. The motor carriage 30 is then reswiveled and locked into place to obtain the proper belt tension.

The sanding cylinder 31 also includes a plurality of integral spokes 33 within the cylinder itself, as shown in FIG. 3. These spokes 33 are formed by an extrusion process. This configuration of the spokes allows for maximum strength in the sanding cylinder with a minimum amount of weight. The spokes configuration also allows for a constant cross section and uniform amount of metal throughout the length of the sanding cylinder 31, so that the sanding cylinder does not become warped after extended use due to high temperatures.

Figure 4:
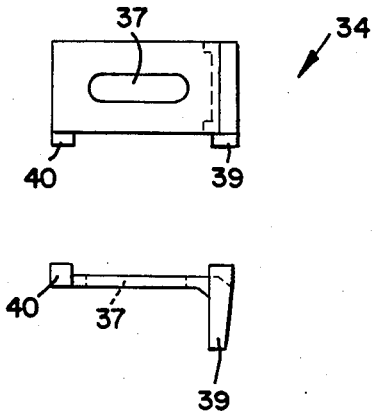
FIG. 4 is a plan and side elevational view of the slide fastener attachment for the drum sander.
Figure 5:
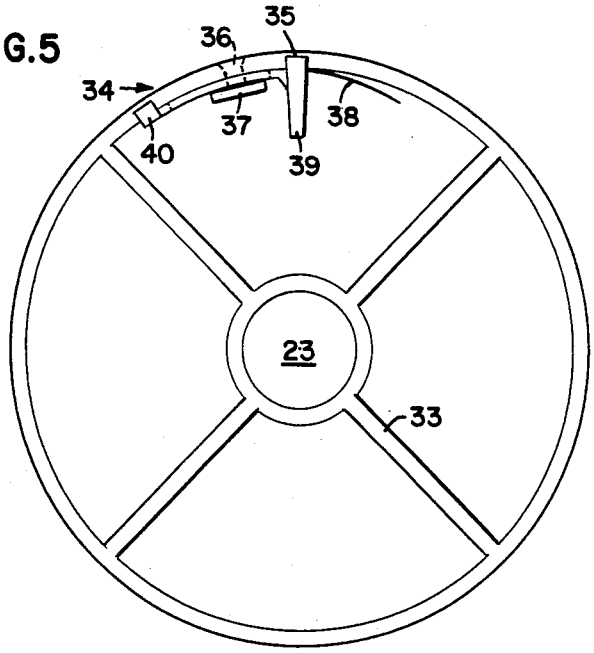
FIG. 5 is a side elevational view of the sanding cylinder with the slide fastener attached.

The sandpaper strips 60 are spiraled onto the sanding cylinder 31 and affixed on each end by means of a slide fastener 34, illustrated in FIGS. 4 and 5. The sanding cylinder 31 has a relatively short sandpaper feed groove 35 on each end. The groove 35 runs parallel to the axis of the sanding cylinder 31. The sandpaper feed groove 35 is narrow and approximately one inch (1") in length. There is a rivet 36 through the wall of the sanding cylinder 31 near the sandpaper feed groove 35 having a rivet head 37 on the inside of the cylinder 31. The slide fastener 34 has a longitudinal slot 37, and the longitudinal slot 37 is held against the inside wall of the sanding cylinder 31 by the rivet head 37. To attach the end 38 of the sandpaper strip 60, the slide fastener 34 is placed in its release position by moving the slide fastener 34 along the rivet head 37 so that the slide fastener 34 does not cover the sandpaper feed groove 35. The sandpaper end 38 is then inserted through the sandpaper feed groove 35, and the slide fastener 34 is moved along the rivet head 37 to the opposite end of the slot 37 until the slide fastener reaches its holding position, at which time the slide fastener 34 covers the sandpaper feed groove 35. The slide fastener also includes a switch 39 which conveniently serves as a handle for the user when the slide faster 34 is moved. A guide 40 has a lip portion which touches the edge of the sanding cylinder 31 to maintain proper position of the slide fastener 34. Slide fasteners 34 are preferably provided at each end of the sanding cylinder 31 in order to securely attach each end of the sandpaper strip 60. The slide fastener 34 is formed to be flat, but it curves slightly when held against the curved inner wall of the sanding cylinder 31, thereby providing a spring tension on the slide fastener 34. The slide fastener 34 is preferably made of plastic to enable it to bend slightly when positioned against the sanding cylinder 31.

Consistent with the teachings of the present invention, other types of cylinders may be used to replace the sanding cylinder 31. For example, the user can replace the sanding cylinder 31 with a planing or molding cylinder in order to perform different woodworking functions.

Construction details of the clamp 19 are illustrated in FIG. 6. The clamp 19 comprises a clamp support piece 41, a clamp jaw 42, and a clamp screw 43. The clamp support piece 41 is preferably integral with the carriage arm 11 for enhanced strength. The clamp 19 is preferably made of aluminum. The clamp jaw 42 has transverse threaded bores 44 therein to accommodate the clamp screw 43. The clamp pieces 41 and 42 also have substantially semi-circular, facingly disposed clamping surfaces 45 and 46. These clamping surfaces 45 and 46 are preferably formed at oblique angles 47 relative to each other in order to enable the clamp 19 to accommodate almost any diameter of vertical support 17. The clamp handle 48 is rotated by the user to force the clamp jaw 42 to move either closer or farther from the clamp support piece 41. This operation allows for vertical adjustment and tightening of the clamp 19 and the attached drum sander 10 relative to the work table 22.

Because the sanding cylinder 31 is supported on only one end in the preferred embodiment, the user is able to sand wood without any obstructions on that end. Thus, a much wider piece of wood may be sanded. The operator can first feed one side of the board through the drum sander 10, and then turn the board around to sand the opposite side. This allows a board of twice the width of the sanding cylinder to be sanded than if there were a support at each end. In the preferred embodiment, the sanding cylinder 31 is twenty-two (22) inches in length, so that a forty-four (44) inch wide board may be sanded. The sanding cylinder is approximately five (5) inches in diameter. In addition, the strength of the carriage arm 11 supports the sanding cylinder 31 as a cantilever in a stable horizontal position parallel to the work table 20. Although the sanding cylinder 31 does not sag on its unsupported end, there is a slight amount of flex at that end. This flex allows a board to be sanded without the formation of an undesirable groove in the wood at the point corresponding to the end of the sanding cylinder.

Figure 8:
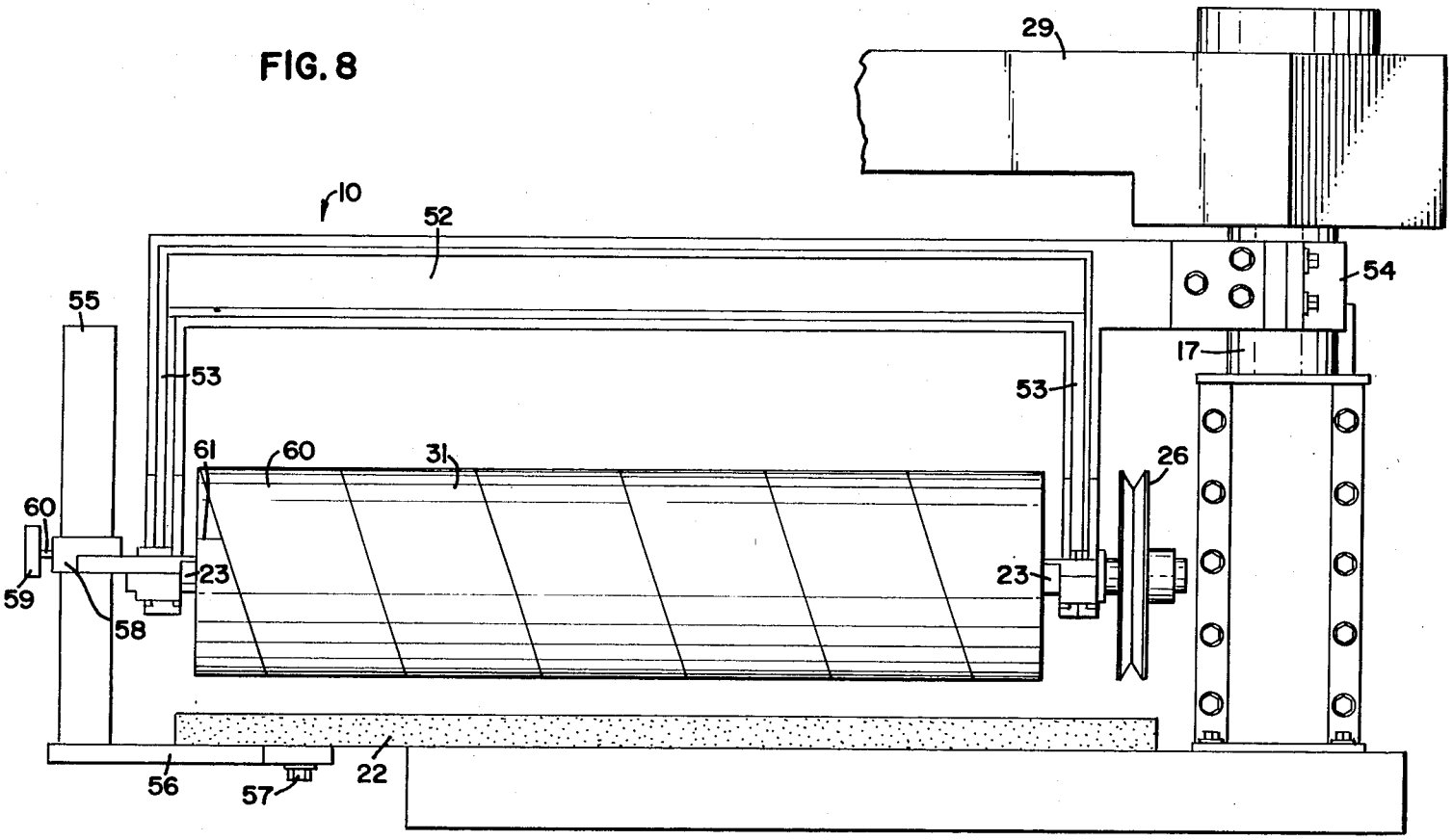
FIG. 8 is a side elevational view of an alternate embodiment of the drum sander.

The drum sander 10 of the present invention also features a dust collector 16, as shown in FIGS. 1 and 8. The dust collector 16 is provided on each end with a pair of tabs 50. Each tab 50 attaches to each end of seats 15 on the vertical carriage legs 12. The relatively flexible tabs 50 are angled so that they bend slightly during attachment and then attach securely to the seats 15. This attachment is illustrated by the partial cutaway section taken at the right end of the sanding cylinder 31 in FIG. 1. The dust collector 16, when in place, covers the upper portion of the sanding cylinder 31 to keep the workshop neat and to prevent sawdust and wood shavings from flying up and injuring the operator. The dust collector 16 is also provided with a longitudinal vacuum slot 51 which runs the entire length of the dust collector 16. This longitudinal vacuum slot 51 is attached to the vacuum hose 49 of a shop vacuum (not shown) for collection of the sawdust and wood shavings. The dust collector 16 may be made of either a rigid plastic or aluminum, and can be formed by extrusion processes. Baffles 67 are provided between the main dust collector chamber 68 and the vacuum slot 51 to facilitate the vacuum action.

Figure 9:
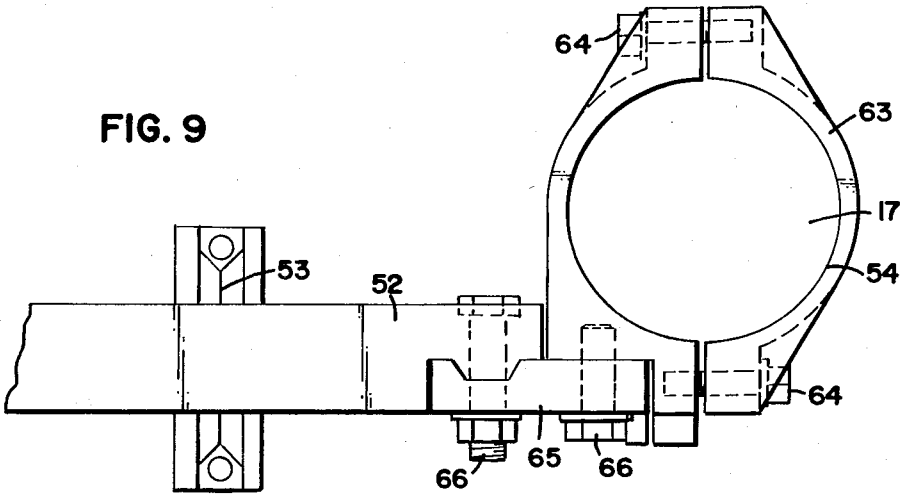
FIG. 9 is a plan view of the sleeve member of the alternate embodiment of the present invention.
Figure 10:
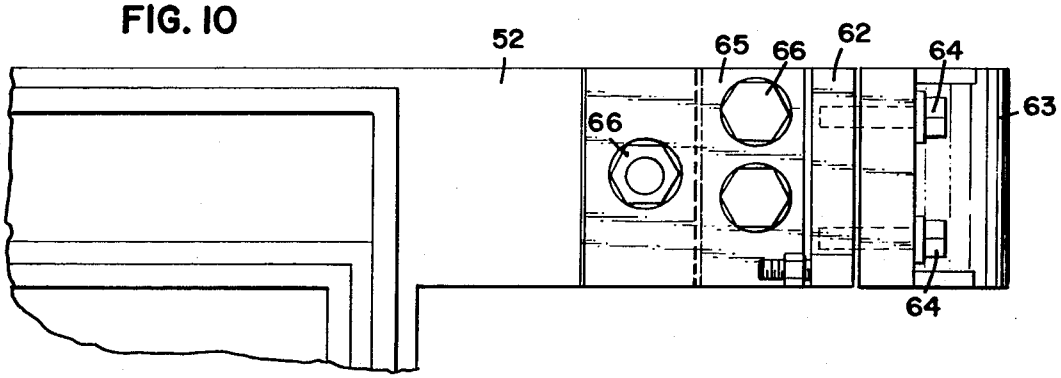
FIG. 10 is a side elevational view of the sleeve member shown in FIG. 9.

An alternate embodiment of the present invention is shown in FIGS. 8–10. In this embodiment, the sanding cylinder 31 is supported by a U-shaped, integral carrier bracket 52. The sanding cylinder 31 has a central shaft 23 running therethrough. The vertical ends 53 of the Ushaped carrier bracket 52 each have an aperture to accommodate the central shaft 23. On one end of the sanding cylinder 31, a sleeve member 54 attaches the carrier bracket 52 to the vertical support 17, which may or may not be a vertical adjustable column of a radial arm saw. On the opposite end of the carrier bracket 52, the drum sander 10 is supported by a column supoport member 55. The column support member 55 is attached to the work table 22 by means of a plate 56, one end of which is rigidly secured by a suitable fastener 57, such as a bolt, to the underside of the work table 22. The column support member 55 has an annular collar 58 with a locking knob 59 and set screw 60. When the height of the drum sander 10 needs to be adjusted vertically, the operator simply unscrews the locking knob 59 and moves the annular collar 58 to the desired position on the column support 55 before re-tightening the locking knob 59 and annular collar 58.

The opposite end of the carrier bracket 52 is affixed to the vertical support member 17 by means of the sleeve member 54. The sleeve member 54 comprises two, facingly disposed half-cylindrical pieces 62 and 63, which are interconnected by one or more suitable fasteners 64 such as bolts. The intermediate connector piece 65 connects the carrier bracker 52 to the sleeve member 54. The connector piece 65 has a plurality of suitable fasteners 66, such as bolts, to provide this connection. In operation, the user positions the sleeve member 54 upon the vertical support 17 at the desired height. When the sanding cylinder 31 is removed from the vertical support 17, the user merely unfastens the bolt 66. The sleeve member 54 and the connector piece 65 remain mounted on the vertical column 17. When the sanding cylinder 31 is remounted above the work table 22, no repeated adjustment of the sanding cylinder is necessary; the user need only refasten the fastener 66.

It is to be understood that numerous and varied modifications can be readily devices in accordance with the principles of the present invention by those skilled in the art without departing from the spirit and scope of the invention. Therefore, it is not desired to restrict the invention to the particular constructions illustrated and described, but to cover all modifications that may fall within the scope of the appended claims.

I claim:

1. A drum sander accessory for radial arm saws of the type having a vertical adjustable column supporting a horizontal saw arm which is parallel to a horizontal work table and having a motor with a drive shaft, comprising:

(a) a sanding cylinder substantially parallel to and spaced above said work table, having an inside and outside, and having a first end proximate said vertical column and an opposite second end, the outside of said cylinder having an abrasive strip thereon and the inside of said cylinder having a central shaft extending therethrough and beyond each end of said sanding cylinder;

(b) two vertical carriage legs attached to and extending above each end of said sanding cylinder, said vertical carriage legs each having an aperture to accommodate said central shaft;

(c) a substantially horizontal carriage arm spaced above said sanding cylinder, having a first and second end corresponding to said first and second end on said sanding cylinder, connected on each end to said vertical carriage legs;

(d) a clamp rigidly connected to said first end of said carriage arm which is clamped onto said vertical column for vertical adjustment and tightening of said sanding cylinder;

(e) a driven pulley having a central bore through which said first end of said central shaft is inserted; and (f) an arbor drive pulley connected to said drive shaft of said radial arm saw and connected to said driven pulley by means of a belt, whereby said sanding cylinder is rotated and wood is sanded when inserted beneath said sanding cylinder.

2. A drum sander according to claim 1, wherein said sanding cylinder, carriage arm, carriage legs, and clamp are made of aluminum.

3. A drum sander according to claim 1, wherein the inside of said sanding cylinder has a plurality of spokes therein, said sanding cylinder being formed from an extrusion process.

4. A drum sander according to claim 1, wherein said clamp has a first end proximate said carriage arm and an opposite second end, comprising:

(a) a clamp support piece integral with said carriage arm, said clamp support piece having a substantially semicircular clamping surface disposed porximate said second end;

(b) a clamp screw inserted through said threaded bore, one end of said clamp screw having a clamp screw handle; and (c) a clamp jaw having a substantially semicircular clamping surface oppositely facing said clamping surface of said clamp support piece, said first end of said clamp jaw having a transverse threaded bore through which said clamp screw is inserted, wherein the rotation of said clamp screw handle causes said clamp jaw to move relative to said clamp support piece to allow vertical adjustment and tightening of said clamp and attached drum sander.

5. A drum sander according to claim 1, wherein said sanding cylinder is about twenty-two (22) inches in length.

6. A drum sander according to claim 1, further comprising a substantially semicylindrical dust collector, each longitudinal end of said dust collector having tabs which attach to each vertical carriage leg, said dust cover having a longitudinal vacuum slot which attaches to a vacuum hose proximate said vertical support, said dust collector covering the upper portion of said sanding cylinder.

7. A drum sander according to claim 6, wherein said dust collector is made of plastic.

8. A drum sander according to claim 6, wherein said dust collector is made of aluminum.

9. A drum sander accessory for radial arm saws of the type having a vertical adjustable column supporting a horizontal saw arm which is parallel to a horizontal work table and having a motor with a drive shaft, comprising:

(a) a sanding cylinder substantially parallel to and spaced above said work table, having a first end proximate said vertical colummn of said radial arm saw and an opposite second end, said cylinder having an abrasive strip thereon and a central shaft extending therethrough and beyond each end of said sanding cylinder;

(b) a U-shaped carrier bracket having a first and second vertical end corresponding to said first and second ends on said sanding cylinder, with an integral horizontal member between said vertical ends, each vertical end of said bracket having an aperture to accommodate said central shaft;

(c) a column support rigidly attached to said work table and connected to said second vertical end of said carrier bracket for support thereof, said column support having an annular collar with a locking knob and set screw which surrounds said column support, whereby said second end of said sanding cylinder can be adjusted vertically and tightened into the desired position by said locking knob;

(d) a sleeve member connected to said first end of said carrier bracket proximate said horizontal member which is clamped onto said vertical adjustable saw column for vertical adjustment of said first end of said sanding cylinder;

(e) a driven pulley having a central bore through which said frist end of said central shaft is inserted; and (f) an arbor drive pulley connected to said drive shaft of said radial arm saw and connected to said driven pulley by means of a belt, whereby said sanding cylinder is rotated and wood is sanded when inserted beneath said sanding cylinder.

10. The drum sander according to claim 9, wherein said column support is attached to said work table by means of a plate, one end of which is rigidly secured to the bottom of said column support, the opposite end of said plate being fastened to the bottom of said work table.

11. A drum sander according to claim 9, wherein said sleeve member comprises two, facingly disposed half-cylindrical pieces interconnected by a bolt and an intermediate connector piece having a plurality of bolts, which is disposed between and connects said first end of said carrier bracket to said sleeve member, whereby said carrier bracket can be removed from said saw and said sleeve member and connector piece remain attached thereto.

12. A drum sander according to claim 9, wherein said sanding cylinder, said carrier bracket, and said sleeve member are made of aluminum.

13. An attachment mechanism for attaching sandpaper to a sanding cylinder, comprising:

(a) a sandpaper feed groove formed in an end of said sanding cylinder parallel to the axis of said sanding cylinder;

(b) a rivet disposed proximate said sandpaper feed groove having a rivet head on said inside of said sanding cylinder;

(c) a slide fastener having a longitudinal slot, held against said inside wall of said sanding cylinder by said rivet head, said longitudinal slot being substantially perpendicular to the axis of said sanding cylinder, wherein said slide fastener slides along said rivet head for the length of said slot, so that when said rivet head is at one end of said slot, said slide fastener covers said sandpaper feed groove and is in its holding position, and when said rivet head is at the opposite end of said slot, said slide fastener does not cover said sandpaper feed groove and is in its release position.

14. The attachment mechanism according to claim 13, wherein said slide fastener is made of plastic.

15. The attachment mechanism according to claim 13, further comprising:

(a) a switch integral with said slide fastener and extending therefrom at a substantially perpendicular angle to facilitate movement of said slide fastener by the user; and (b) a guide positioned along one longitudinal edge of said slide fastener and integral therewith, said guide extending along the edge of said sanding cylinder to maintain proper position of said slide fastener.

16. A drum sander accessory for radial arm saws of the type having a vertical adjustable column supporting a horizontal saw arm which is parallel to a horizontal work table and having a motor with a drive shaft, comprising:

(a) an aluminum sanding cylinder substantially parallel to and spaced above said work table, having an inside and outside, and having a first end proximate said vertical column and an opposite second end, the outside of said cylinder having an abrasive sandpaper strip spiralled thereon and the inside of said cylinder having a central shaft extending therethrough and beyond each end of said sanding cylinder;

(b) two aluminum vertical carriage legs attached to and extending above each end of said sanding cylinder, said vertical carriage legs each having an aperture to accommodate said central shaft;

(c) an aluminum, substantially horizontal carriage arm spaced above said sanding cylinder, having a first and second end corresponding to said first and second end on said sanding cylinder, connected on each end to said vertical carriage legs;

(d) a clamp rigidly connected to said carriage arm and clamped onto said vertical column for vertical adjustment and tightening of said sanding cylinder, having a first end proximate said carriage arm and an opposite second end, comprising:

(i) a clamp support piece integral with said carriage arm, said clamp support piece having a substantially semicircular clamping surface disposed proximate said second end;

(ii) a clamp screw having a clamp screw handle; and (iii) a clamp jaw having a substantially semicircular clamping surface oppositely facing said clamping surface of said clamp support piece, said first end of said clamp jaw having a transverse threaded bore through which said clamp screw is inserted, wherein the rotation of said clamp screw handle causes said clamp jaw to move relative to said clamp support piece to allow vertical adjustment and tightening of said clamp and attached drum sander;

(e) an attachment mechanism for attaching sandpaper to said sanding cylinder, comprising:

(i) a sandpaper feed groove formed in an end of said sanding cylinder parallel to the axis of said sanding cylinder;

(ii) a rivet disposes proximate said sandpaper feed groove having a rivet head on said inside of said sanding cylinder;

(iii) a slide fastener having a longitudinal slot, held against said inside wall of said sanding cylinder by said rivet head, said longitudinal slot being substantially perpendicular to the axis of said sanding cylinder, wherein said slide fastener slides along said rivet head for the length of said slot, so that when said rivet head is at one end of said slot, said slide fastener covers said sandpaper feed groove and is in its holding position, and when said rivet head is at the opposite end of said slot, said slide fastener does not cover said sandpaper feed groove and is in its release position;

(f) a driven pulley having a central bore through which said first end of said central shaft is inserted; and (g) an arbor drive pulley connected to said drive shaft of said radial arm saw and connected to said driven pulley by means of a belt, whereby said sanding cylinder is rotated and wood is sanded when inserted beneath said sanding cylinder.

* * * * *